US012546176B2

(12) United States Patent
Massey et al.

(10) Patent No.: US 12,546,176 B2
(45) **Date of Patent: *Feb. 10, 2026**

(54) WIRELINE PRESSURE CONTROL STRING WITH PUMPDOWN ASSEMBLY

(71) Applicant: FMC Technologies, Inc., Houston, TX (US)

(72) Inventors: Corey Massey, Norman, OK (US); James Cook, Granbury, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/738,461

(22) Filed: Jun. 10, 2024

(65) Prior Publication Data

US 2024/0328271 A1 Oct. 3, 2024

Related U.S. Application Data

(63) Continuation of application No. 17/838,007, filed on Jun. 10, 2022, now Pat. No. 12,024,966.

(51) Int. Cl.

| | |
|---|---|
| ***E21B 23/08*** | (2006.01) |
| ***E21B 23/04*** | (2006.01) |
| ***E21B 33/072*** | (2006.01) |
| ***E21B 34/02*** | (2006.01) |

(52) U.S. Cl.

CPC ..... *E21B 23/08* (2013.01); *E21B 23/04* (2013.01); *E21B 33/072* (2013.01); *E21B 34/02* (2013.01)

(58) Field of Classification Search

CPC ..... E21B 23/04; E21B 34/10; E21B 33/076; E21B 34/16; E21B 23/08; E21B 43/12; E21B 23/02; E21B 23/00; E21B 33/03

See application file for complete search history.

(56) References Cited

U.S. PATENT DOCUMENTS 4,077,472 A * 3/1978 Gano ..... E21B 33/043 166/359
4,214,605 A * 7/1980 Hardgrave ..... E21B 33/062 251/1.3

(Continued)

FOREIGN PATENT DOCUMENTS

GB 2182180 A * 5/1987 ..... E21B 34/16
WO WO-2005047639 A2 * 5/2005 ..... E21B 33/043

*Primary Examiner* — Daniel P Stephenson
(74) *Attorney, Agent, or Firm* — Henry C. Query, Jr.

(57) ABSTRACT

A pumpdown system for use in performing wireline operations on a well bore includes a wellhead assembly positioned at the top of the well bore, a pumpdown fluid source, a flowline having a first end connected to the pumpdown fluid source and an opposite second end, and a wireline pressure control string releasably connectable to the wellhead assembly. The wireline pressure control string includes a pumpdown sub having a body and a through bore which extends through the body, at least one pumpdown valve having an inlet connected to the second end of the flowline and an outlet in fluid communication with the through bore, and a connector positioned below the pumpdown assembly for releasably securing the wireline pressure control string to the wellhead assembly. In operation of the pumpdown system, the wireline pressure control string is connected to the wellhead assembly and fluid from the pumpdown fluid source is conveyed through the flowline, the pumpdown valve and the pumpdown sub into the well bore.

14 Claims, 7 Drawing Sheets

(56) References Cited

U.S. PATENT DOCUMENTS 4,256,180 A * 3/1981 Mott ..... E21B 23/08 166/322
4,706,756 A * 11/1987 Dean ..... E21B 33/076 166/344
4,886,115 A * 12/1989 Leggett ..... E21B 33/072 166/217
5,012,865 A * 5/1991 McLeod ..... E21B 34/02 166/95.1
6,918,439 B2 * 7/2005 Dallas ..... E21B 33/12 166/97.1
7,114,571 B2 * 10/2006 Gatherar ..... E21B 33/043 166/89.2
9,702,215 B1 * 7/2017 Murphy ..... E21B 34/04
11,015,413 B2 * 5/2021 Guidry ..... E21B 43/2607
12,024,966 B2 * 7/2024 Massey ..... E21B 23/08
2005/0189115 A1 * 9/2005 Rytlewski ..... E21B 47/00 166/344
2010/0032163 A1 * 2/2010 Richards ..... E21B 33/035 166/344
2011/0094749 A1 * 4/2011 Richards ..... E21B 33/076 166/345
2013/0048309 A1 * 2/2013 Young ..... E21B 23/00 166/85.1
2016/0245035 A1 * 8/2016 Brady ..... E21B 43/116
2017/0204714 A1 * 7/2017 Roesner ..... E21B 33/03
2018/0163501 A1 * 6/2018 Guidry ..... E21B 43/26
2019/0032439 A1 * 1/2019 Smith ..... E21B 19/008
2019/0203571 A1 * 7/2019 Hartley ..... E21B 33/035
2019/0284901 A1 * 9/2019 Murphy ..... E21B 33/035
2020/0131872 A1 * 4/2020 Rønne ..... E21B 33/076
2021/0062617 A1 * 3/2021 Pillai ..... E21B 47/117
2021/0310322 A1 * 10/2021 Greenlee ..... E21B 21/103
2022/0186577 A1 * 6/2022 Boyd ..... E21B 33/0353
2023/0399908 A1 * 12/2023 Massey ..... E21B 23/04
2024/0328271 A1 * 10/2024 Massey ..... E21B 23/08

* cited by examiner

WIRELINE PRESSURE CONTROL STRING WITH PUMPDOWN ASSEMBLY

The present application is a continuation of U.S. patent application Ser. No. 17/838,007 filed on Jun. 10, 2022.

The present disclosure is directed to a wireline pressure control string for performing wireline operations on hydrocarbon wells. More particularly, the present disclosure is directed to a wireline pressure control string which includes a pumpdown assembly for controlling the flow of fluid into the well bore during a wireline operation in order to, for example, propel a wireline tool through the well bore. The wireline pressure control string of the present disclosure therefore eliminates the need to provide the wellhead assembly (or assemblies, in a multi-well application) with separate pumpdown valves and associated pumpdown flowline assemblies. One embodiment of the present disclosure is also directed to a wireline pressure control string in which the pumpdown valve is connected to the pumpdown fluid source using a flexible flowline, thereby enabling the wireline pressure control string to be easily maneuvered around the well site.

BACKGROUND OF THE DISCLOSURE

Hydraulic fracturing, or "fracking", is a common technique for enhancing the extraction of oil and gas from a hydrocarbon well. Fracking involves injecting a high pressure fracking fluid, or frac fluid, into the well bore in order to create fissures in the hydrocarbon formation through which the oil or gas may flow. Prior to this step, however, the production casing lining the well bore must be perforated. The perforation operation is performed using a perforating gun, which is often deployed on a wireline. The perforating gun is lowered into the well bore using a wireline pressure control string connected to the top of the frac tree. The wireline stack maintains pressure control of the well when the perforating gun is deployed in the well bore.

In many cases, the production casing must be perforated along a laterally extending branch of the well bore. However, gravity alone is typically not sufficient to move the perforating gun toward the perforating zones. In these cases, the perforating gun is typically propelled into the well bore using a pumpdown fluid, such as water. The pumpdown fluid is commonly conveyed to the well bore through a set of pumpdown valves on the frac tree. The pumpdown valves are connected to the pumpdown fluid source through a pumpdown flowline assembly, which normally includes numerous rigid pipes, valves and fittings.

Since each well on a multi-well frac pad must usually be fracked, this arrangement requires that each frac tree have its own set of pumpdown valves and that each set of pumpdown valves be connected to the pumpdown fluid source through a respective pumpdown flowline assembly. As a result, the complete pumpdown flowline assembly may be complicated and time consuming to assemble. In addition, each connection between the individual components of the pumpdown flowline assembly and between the pumpdown flowline assembly and the pumpdown valves represents a potential leak path.

SUMMARY OF THE DISCLOSURE

In accordance with the present disclosure, these and other disadvantages are addressed by providing a wireline pressure control string for performing wireline operations on a hydrocarbon well having a well bore and a wellhead assembly positioned at the top of the well bore. The wireline pressure control string comprises a pumpdown assembly which includes a pumpdown sub having a body and a through bore which extends axially through the body and is fluidly connectable to the well bore, and at least one pumpdown valve having an inlet which is fluidly connectable to a pumpdown fluid source and an outlet which is fluidly connected to the through bore.

In certain embodiments, the wireline pressure control string may also include means for releasably securing the wireline pressure control string to the wellhead assembly. Such means may include, for example, a power-operated connector which is connected to the wireline pressure control string and is configured to operatively engage an adapter on the wellhead assembly. As an alternative, the means for releasably securing the wireline pressure control string to the wellhead assembly may comprise an adapter which is connected to the wireline pressure control string and is configured to be engaged by a power-operated connector on the wellhead assembly.

In certain embodiments, the wireline pressure control string may also include a flexible flowline for fluidly connecting said at least one pumpdown valve to the pumpdown fluid source. In embodiments in which the at least one pumpdown valve comprises a power-operated valve actuator which is operated through at least one valve control cable, the wireline pressure control string may further comprise an umbilical within which the flexible flowline and the at least one valve control cable are incorporated.

The present disclosure is also directed to a method for performing a wireline operation on a hydrocarbon well having a well bore and a wellhead assembly positioned at the top of the well bore. The method includes the steps of connecting a wireline pressure control string to a component of the a wellhead assembly, and pumping a fluid from a pumpdown fluid source through the wireline pressure control string to propel a wireline tool through the well bore. The step of pumping a fluid through the wireline pressure control string is performed using a pumpdown assembly which includes a pumpdown sub comprising a body and a through bore which extends axially through the body and is fluidly connected to the well bore, and at least one pumpdown valve comprising an inlet which is fluidly connectable to the pumpdown fluid source and an outlet which is fluidly connected to the through bore. In certain embodiments, the at least one pumpdown valve may be fluidly connected to the pumpdown fluid source with a flexible flowline.

Thus, by incorporating the pumpdown assembly into the wireline pressure control string, the need to provide the wellhead assemblies, such as frac trees, with separate pumpdown valves and associated pumpdown flowline assemblies is eliminated. Also, in embodiments in which the pumpdown valve is connected to the pumpdown fluid source using a flexible flowline, the wireline pressure control string can be easily installed on the wellhead assembly and moved from wellhead assembly to wellhead assembly with little or no need for manual intervention.

These and other objects and advantages of the present disclosure will be made apparent from the following detailed description, with reference to the accompanying drawings. In the drawings, the same reference numbers may be used to denote similar components in the various embodiments.

DETAILED DESCRIPTION OF THE DISCLOSURE

Figure 1:
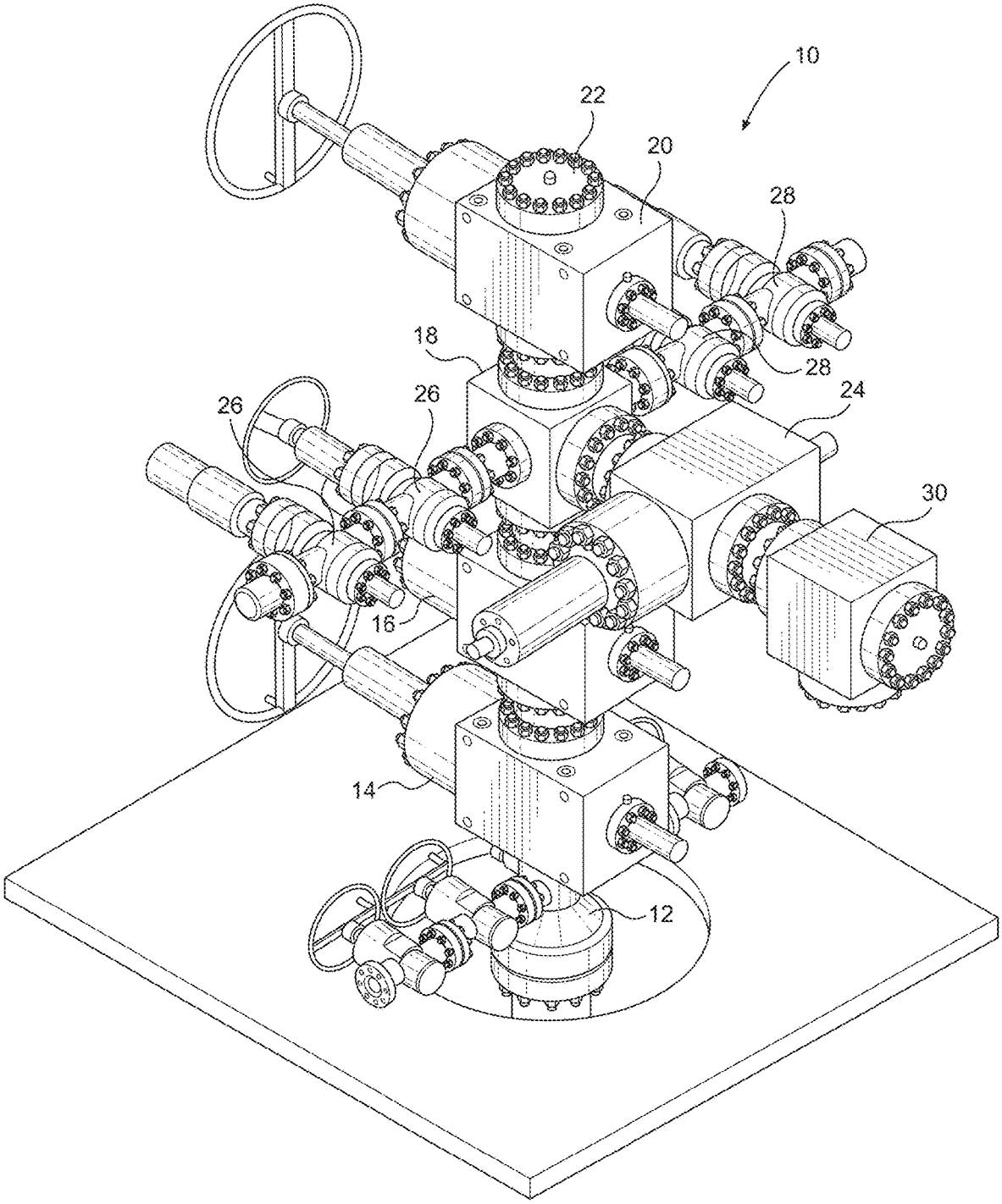
FIG. 1 (Prior Art)
FIG. 1 is a perspective view of an illustrative prior art wellhead assembly in the form of a frac tree.

The present disclosure is directed to a wireline pressure control string for use in performing wireline operations on a hydrocarbon well. Such hydrocarbon wells can be defined by a well bore and a wellhead assembly which is positioned at the top of the well bore. In the context of the present application, a wellhead assembly may comprise any apparatus which is designed to control the flow of fluid into and out of the well bore, such as, e.g., a christmas tree, a frac tree, a frac stack, a frac head, a wellhead and a tubing spool, among others.

The wireline pressure control string includes a novel pumpdown assembly for controlling a flow of fluid into the well bore during a wireline operation in order to, for example, propel a wireline tool through the well bore. The fluid, which may be referred to herein as a pumpdown fluid, may comprise, e.g., water. In one embodiment of the disclosure, the pumpdown assembly includes a pumpdown sub having a body and a through bore. The through bore extends axially through the body and is fluidly connectable to the well bore. The pumpdown sub may also include at least one valve having an inlet which is fluidly connectable to a source of the pumpdown fluid (which may be referred to herein as a pumpdown fluid source) and an outlet which is fluidly connected to the through bore.

A connector is provided for releasably securing the wireline pressure control string to the wellhead assembly. In one embodiment, the connector is mounted directly to the wireline pressure control string below the pumpdown assembly and is configured to connect to a component of the wellhead assembly, such as, e.g., an adapter which is pre-installed on the top of the wellhead assembly. In another embodiment, the connector is mounted directly to the wellhead assembly and is configured to connect to a component of the wireline pressure control string, such as, e.g., an adapter which is pre-connected to the pressure control string below the pumpdown assembly. In certain embodiments, the connector is a power-operated connector which is operated via one or more power cables. For example, if the connector is a hydraulically operated connector, the power cable or cables may comprise hydraulic hoses. In other embodiments, the connector comprises a first connector half which is mounted to the pressure control string and a second connector half which is mounted to the wellhead assembly, and the first and second connector halves are secured together manually.

In one embodiment of the disclosure, the at least one pumpdown valve may comprise a power-operated valve actuator. The power-operated valve actuator may comprise, for example, a hydraulically operated valve actuator. In other embodiments, the power-operated valve actuator may comprise an electric or pneumatic actuator. Each power-operated valve actuator is activated via a corresponding power cable. In the case of a hydraulically operated valve actuator, the power cable may comprise a hydraulic hose. In the case of an electric or pneumatic actuator, the power cable may comprise an electric power cable or an air hose, respectively.

In accordance with another embodiment of the present disclosure, a flexible flowline is used to fluidly connect said at least one pumpdown valve to the pumpdown fluid source. In certain embodiments, the flexible flowline may be incorporated into an umbilical which also includes the power cable for the power-operated valve actuator and, optionally, the power cable for the connector.

In certain embodiments, the wireline pressure control string may also include a wireline pressure control head positioned above the pumpdown assembly. In the context of the present application, a wireline pressure control head may comprise any device which is designed to selectively retain pressure in the well bore during a wireline operation. For example, the wireline pressure control head may comprise a wireline valve or a wireline blowout preventer (BOP). The wireline pressure control head may, in certain embodiments, be of the type which is activated using a power cable, such as a hydraulic hose. In this case, the power cable for the wireline pressure control head may be incorporated into an umbilical with the flexible flowline and the power cable for the pumpdown valve actuator.

The wireline pressure control string and pumpdown assembly will be described hereafter in the context of a wellhead assembly in the form of a frac tree which is used in hydraulic fracturing, or fracking, operations. However, it should be understood that the wireline pressure control string and pumpdown assembly may be used in connection with other types of wellhead assemblies.

An example of a prior art frac tree is shown in FIG. 1. The frac tree of this example, which is indicated generally by reference number 10, is shown mounted to the top of a wellhead 12 positioned at the upper end of a well bore (not shown) extending to the hydrocarbon formation. The frac tree 10 is made up of a stack of valves and fittings for controlling the flow of fluid into and out of the well bore, including a lower master valve 14, an upper master valve 16, a flow cross 18 and a swab valve 20. These components define an axially extending tree bore which communicates with the well bore and is normally closed by a tree cap 22.

The frac tree 10 also includes a number of valves for controlling flow into and out of the tree bore through corresponding lateral ports in the flow cross 18, including a wing valve 24, a pair of flowback valves 26 and a pair of pumpdown valves 28. In this example, the wing valve 24 may be connected to a source of fracking fluid via a Tee fitting 30 and a suitable flowline (not shown). Also, the flowback valves 26 may be connected to a separate flowback apparatus, for instance a collecting tank or a fluid processing apparatus (such as a separation apparatus) via a corresponding fluid conduit (not shown), and the pumpdown valves 28 may be connected to a pumpdown fluid source via a corresponding fluid conduit (not shown).

Figure 2:
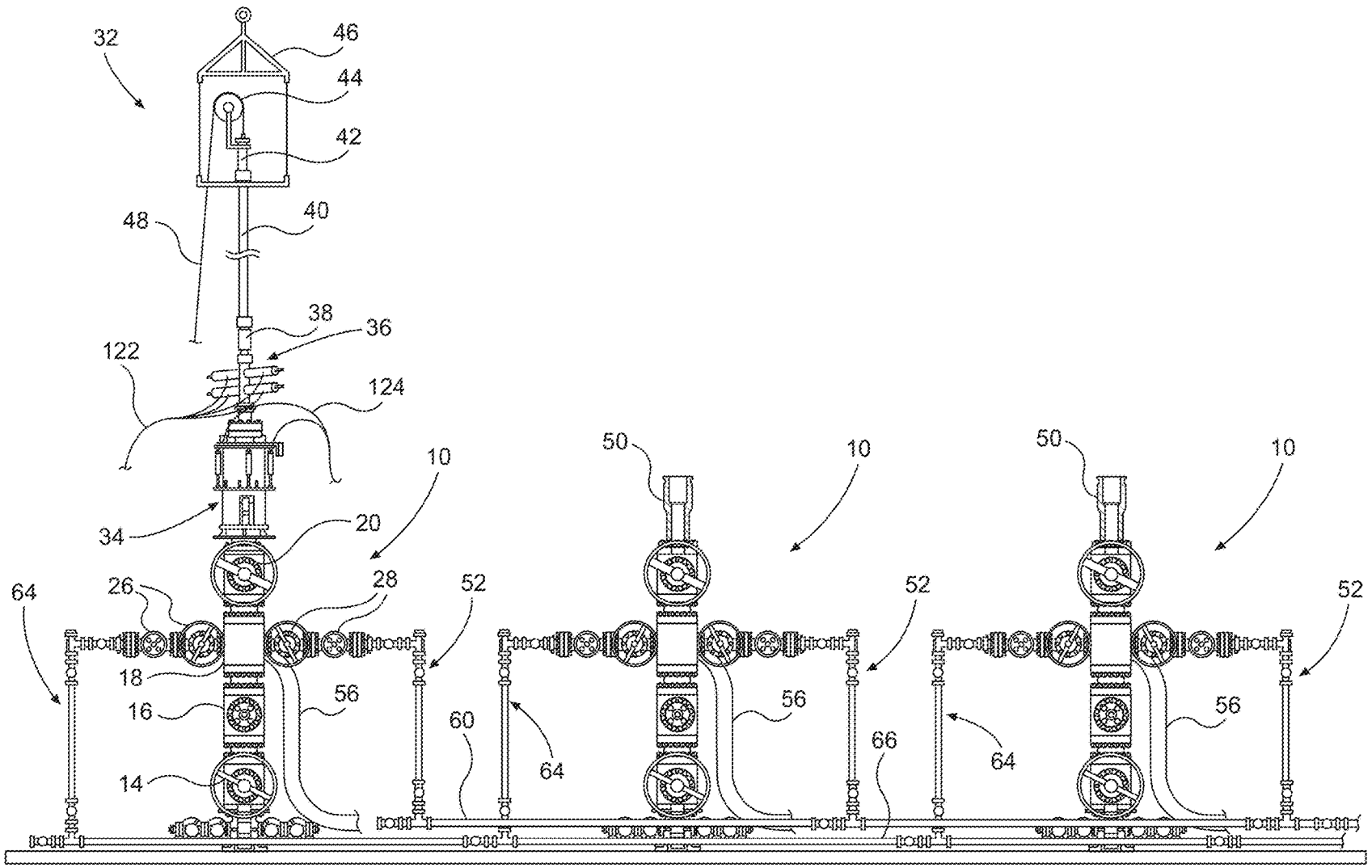
FIG. 2 (Prior Art)
FIG. 2 is a front view of an illustrative prior art frac pad which includes three frac trees of the type shown in FIG. 1 and an example of a prior art wireline pressure control string shown connected to one of the frac trees.

The frac tree 10 is located on a frac pad, i.e., the place where the fracking equipment is located for fracking operations. Certain frac pads may contain more than one frac tree. Referring to FIG. 2, for example, a representation of a frac pad is shown which contains three frac trees 10. Fewer or more frac trees may be required depending on several factors, including the size of the hydrocarbon formation. Each frac tree 10 is connected to a respective well, and when two or more frac trees are present, it may be possible to conduct separate operations on each well.

Bringing a well into production requires several operations. Generally, after the well has been drilled and cased and the frac tree has been installed, the production casing is perforated. Once the perforation operation is completed, the well can be fractured, or fracked. After the well has been fracked, the well is opened and the flowback phase of operation commences. During the flowback phase, the well produces a flowback well stream comprising mostly fracking water and sand, along with some formation fluids. Once the proportion of formation fluids in the well stream reaches a certain level, the well is put into the production phase of operation. If the frac pad contains two or more frac trees, these operations can take place simultaneously on separate wells. For example, if a frac pad contains three frac trees, a perforation operation can be performed on a first well while a fracturing operation is performed on a second well and flowback is taking place at a third well.

A perforation operation involves puncturing holes in the production casing at a number of locations, or zones, along the portion of the production casing which extends through the hydrocarbon formation. The perforation operation is performed using a perforating gun which is often deployed on a wireline. The perforating gun is lowered through the tree bore using a wireline pressure control string, which is sometimes called a wireline string or wireline stack. The wireline stack maintains pressure control of the well when the perforating gun is deployed in the well bore.

An example of a prior art wireline stack is shown connected to the left-most frac tree 10 in FIG. 2. In this simplified example, the wireline stack, generally 32, includes a connector 34 for connecting the wireline stack to the top of the frac tree 10, a wireline pressure control head, such as a wireline valve or wireline BOP 36, which is connected to the top of the connector, a tool trap 38 which is connected to the top of the BOP, a lubricator 40 which is connected to the top of the tool trap, a stuffing box 42 which is connected to the top of the lubricator, a top sheave 44 which is connected to the stuffing box, and a lifting tool 46 which in this example is connected to the lubricator below the stuffing box. The connector 34 shown in FIG. 2 is a power-operated connector, specifically, the Speedloc™-XT hydraulic connector sold by TechnipFMC PLC of Houston, Texas.

The wireline stack 32 is typically made up on the frac pad and then lowered onto the frac tree 10 using a crane (not shown) connected to the lifting tool 46. In this simplified example, the free end of a wireline 48 is trained around the top sheave 44, inserted through the stuffing box 42 and pulled through the lubricator 40. The perforating gun (more typically, a bottom hole assembly comprising the perforating gun, a wireline setting tool and a frac plug) is then fastened to the wireline 48 and retracted into the lubricator 40. After the tool trap 38 is attached to the BOP 36 and the BOP is attached to the connector 34, the lubricator 40 is connected to the top of the tool trap to complete the assembly of the wireline stack 32. The wireline stack 32 can then be lifted and positioned over the frac tree 10 and then secured and sealed to the frac tree by engaging the connector 34 with an adapter 50 that has been pre-attached to the top of the frac tree.

Once the wireline stack 32 is connected to the top of the frac tree 10, the swab valve 20, upper master valve 16 and lower master valve 14 are opened and the perforating gun is lowered through the tree bore and into the well bore. In many cases, the perforating zones are located along a laterally extending branch of the well bore. Consequently, gravity alone is typically not sufficient to move the perforating gun to the perforating zones. In these cases, the perforating gun is propelled or "pumped" into the well bore using a pumpdown fluid, such as water.

The pumpdown fluid is commonly communicated to the well bore through the pumpdown valves 28 on the frac tree 10. The pumpdown fluid source is connected to the pumpdown valves 28 through a pumpdown flowline assembly 52, which typically includes numerous rigid pipes, valves and fittings. Since each well on a multi-well frac pad will need to be fracked, this arrangement requires that each frac tree 10 have its own set of pumpdown valves 28 and that each set of pumpdown valves be connected to the pumpdown fluid source through a respective pumpdown flowline assembly 52.

Figure 3:
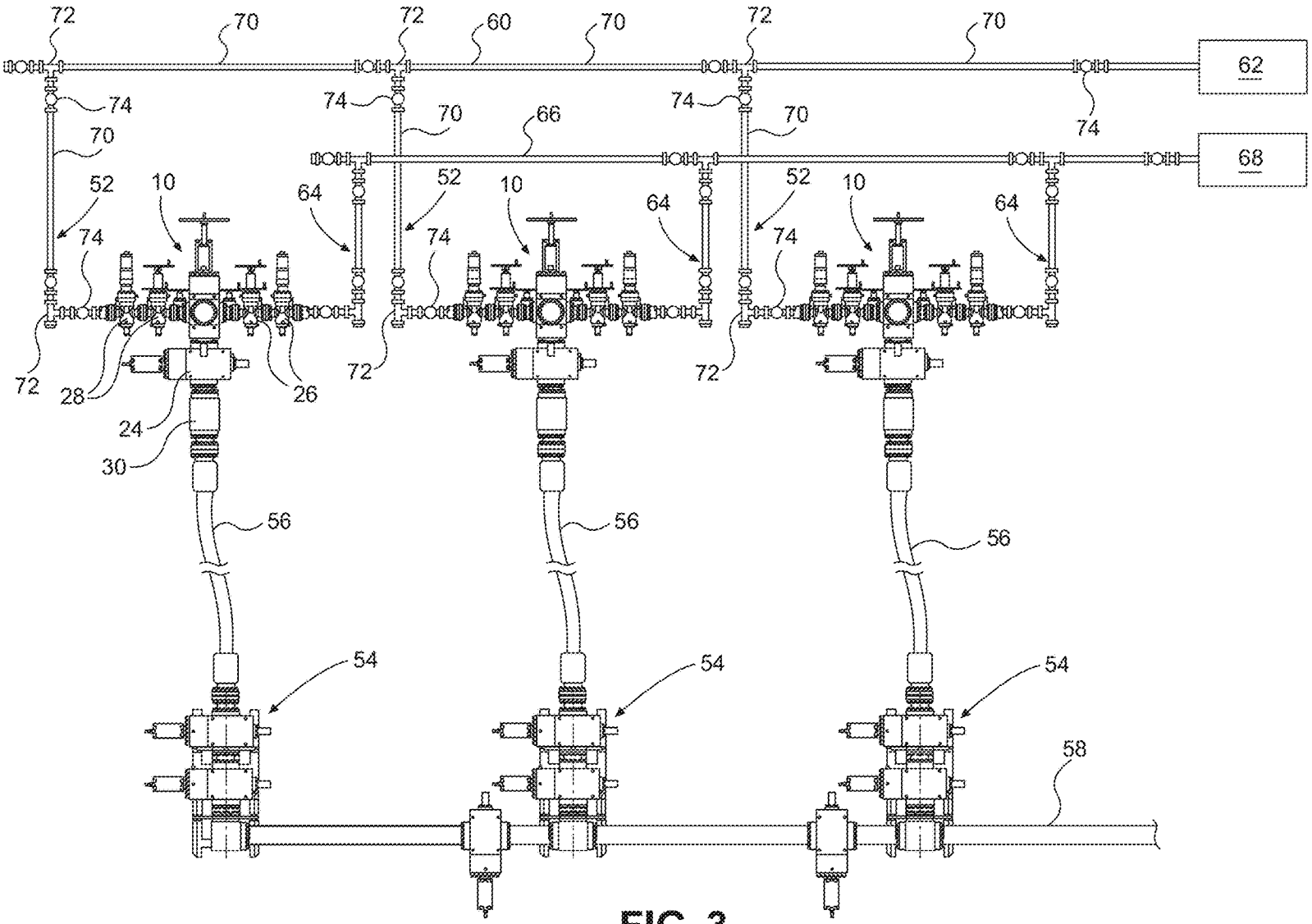
FIG. 3 (Prior Art)
FIG. 3 is a top view of the prior art frac pad depicted in FIG. 2.

Referring also to FIG. 3, which is an overhead representation of the frac pad depicted in FIG. 2, the wing valve 24 of each frac tree 10 in this example is connected through its Tee fitting 30 to a corresponding zipper manifold 54 using a frac flowline 56, such as the WellFlex™ flexible flowline sold by TechnipFMC PLC of Houston, Texas. The zipper manifolds 54 are in turn connected in series through a single frac flowline 58 to a source of high pressure frac fluid (not shown). FIG. 3 also shows how the pumpdown valves 28 of each frac tree 10 are connected via their respective pumpdown flowline assemblies 52 to a common pumpdown flowline assembly 60 which leads to the pumpdown fluid source (represented by box 62), and how the flowback valves 26 of each frac tree 10 are connected via respective flowback flowline assemblies 64 to a common flowback flowline assembly 66 which leads to a flowback apparatus, (represented by box 68), such as, e.g., a collecting tank or a separation apparatus.

As shown in FIG. 3, the complete pumpdown flowline assembly (comprising the individual pumpdown flowline assemblies 52 and the common pumpdown flowline assembly 58) may in practice be made up of numerous components, including several straight pipe segments 70, Tee fittings 72 and plug valves 74. As a result, the complete pumpdown flowline assembly may be complicated and time consuming to assemble. In addition, each connection between the individual components of the pumpdown flowline assembly and between the pumpdown flowline assembly and the pumpdown valves 28 represents a potential leak path.

In accordance with the present disclosure, the need to include individual pumpdown valves 28 on each frac tree 10 (or, more generally, each wellhead assembly) and the concomitant need for an extensive pumpdown flowline assembly to connect the pumpdown valves to the pumpdown fluid source 62 are eliminated by incorporating a unique pumpdown assembly into the wireline stack and connecting the pumpdown assembly to the pumpdown fluid source through a single flowline.

Figure 4:
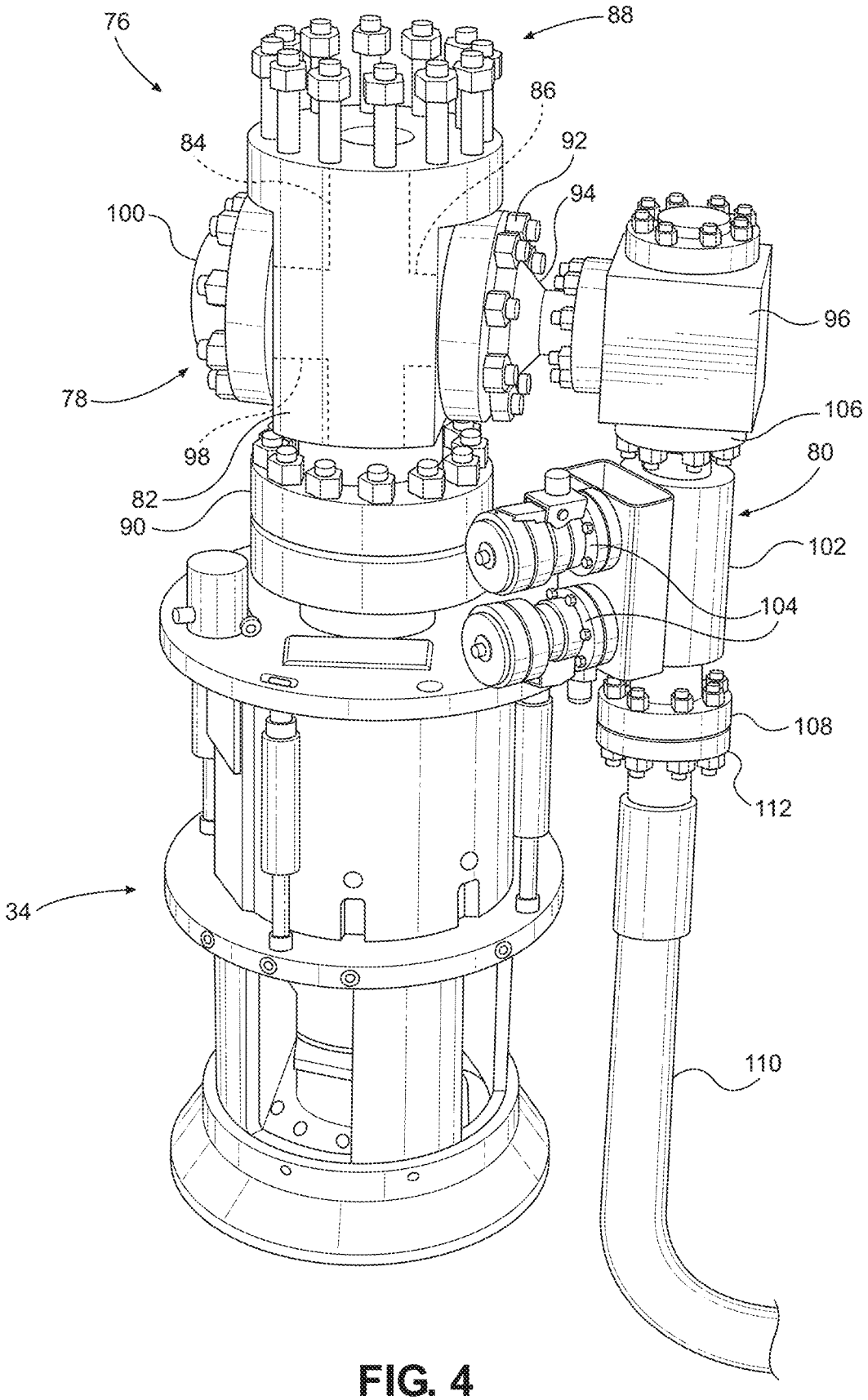
FIG. 4 is a perspective view of one embodiment of the pumpdown assembly of the present disclosure.

Referring to FIG. 4, one embodiment of the pumpdown assembly of the present disclosure, which is indicated generally by reference number 76, includes a pumpdown sub 78 which is connected to a valve assembly 80 that in turn is connectable to the pumpdown fluid source. In this embodiment, the pumpdown sub 78 includes a body 82 having an axial through bore 84 (shown in phantom), a side port 86 (shown in phantom) which extends from the axial through bore to an external surface of the body, a top end connection 88 for connecting the body to a first component of the wireline stack (not shown), a bottom end connection 90 for connecting the body to a second component of the wireline stack, such as the connector 34 shown in FIG. 4, and a side connection 92 for connecting the body to the valve assembly 80, either directly or, as shown in FIG. 4, through a number of pipe fittings, such as, e.g., a reducer 94 and a Tee fitting 96. In certain embodiments of the invention, the pumpdown sub 78 may include a second side port 98 which extends from the axial through bore 84 to the outer surface of the body 82. The second side port 98 may be closed by a blind flange 100 or, if required, fluidly connected to another component, such as a chemical injection hose (not shown).

In the particular example shown in FIG. 4, the top end connection 88 may comprise a studded end connection which is configured to connect with a flanged end connection on the first component, the bottom end connection 90 may comprise a flanged end connection which is configured to connect with a flanged end connection on the second component, and the side connection 92 may comprise a studded end connection which is configured to connect with a flanged end connection on the valve assembly 80 or on a pipe fitting which is disposed between the body 82 and the valve assembly (such as, e.g., the reducer 92 shown in FIG. 4). It should be understood of course that the top and bottom end connections 88, 90 and the side connection 92 may each comprise any suitable connection which is designed to form a secure fit between the body 82 and the components to which the connections are joined.

The valve assembly 80 may comprise a single valve or a combination of two or more valves suitable for controlling the flow of pumpdown fluid from the pumpdown fluid source to the pumpdown sub 78. In the illustrative embodiment of the disclosure shown in FIG. 4, the valve assembly 80 comprises a dual plug valve which includes a valve body 102 having an inlet which is connectable to the pumpdown fluid source, an outlet which is connected to the side port 86 (and thus to the through bore 84), a flowbore extending axially between the inlet and the outlet, and two plug members (not visible) which are positioned across the flowbore and are each actuated by a corresponding valve actuator 104 to open or close the flowbore. In one embodiment of the invention, one or both of the actuators 104 may comprise a power-operated actuator, such as a hydraulic, electric or pneumatic actuator. Such actuators enable the valve assembly 80 to be operated remotely, thereby eliminating the need for manual operation and, consequently, the need for a personnel stand or lift to position a crewperson adjacent the valve assembly 80.

In one embodiment of the disclosure, the valve assembly 80 may comprise any suitable single valve, such as, e.g., a plug valve, a gate valve or a ball valve. In yet another embodiment, the valve assembly 80 may comprise two (or more) suitable valves, such as, e.g., two plug valves, two gate valves or two ball valves, or any combination of suitable valves. Further, each valve of the valve assembly 80 may comprise any appropriate actuator, such as, e.g., a manual, hydraulic, electric or pneumatic actuator 104, or any combination of such actuators.

As shown in FIG. 4, the valve assembly 80 may be connected to the body 82 of the pumpdown sub 78 through a number of pipe fittings, such as, e.g., the reducer 94 and Tee fitting 96. In this embodiment, the valve assembly 80 is provided with a first end connection 106 for connecting the valve body 102 to a corresponding connection on the Tee fitting 96, and a second end connection 108 for connecting the valve body to a corresponding connection on a separate component, such as a fluid conduit 110 which is connectable to the pumpdown fluid source. (As will be discussed below, in certain embodiments the fluid conduit 110 may comprise a flexible flowline.) In one example, the first end connection 106 comprises a flanged end connection which is configured to connect to a studded end connection on the Tee fitting 96, and the second end connection 108 is a flanged end connection which is configured to connect to a flanged end connection 112 on the fluid conduit 110. It should be understood, however, that the first and second end connections 106, 108 may each comprise any suitable connection which is designed to form a secure fit between the valve body 102 and the components to which the end connections are joined.

In an alternative embodiment, the valve assembly 80 may be connected directly to the body 82 of the pumpdown sub 78. In this embodiment, the first end connection 106 is configured to connect with a corresponding connection on the body 82. For example, the first end connection 106 may comprise a flanged end connection which is configured to connect to a studded end connection on the body 82. In another embodiment of the disclosure, the valve assembly 80 may be connected to the body 82 of the pumpdown sub 78 with a single pipe fitting, such as, e.g., a pipe spool, a clamp hub, the reducer 92, the Tee fitting 96 or any other suitable fitting. In yet another embodiment of the disclosure, the valve assembly 80 may be connected to the body 82 of the pumpdown sub 78 using any combination of suitable fittings.

Figure 5:
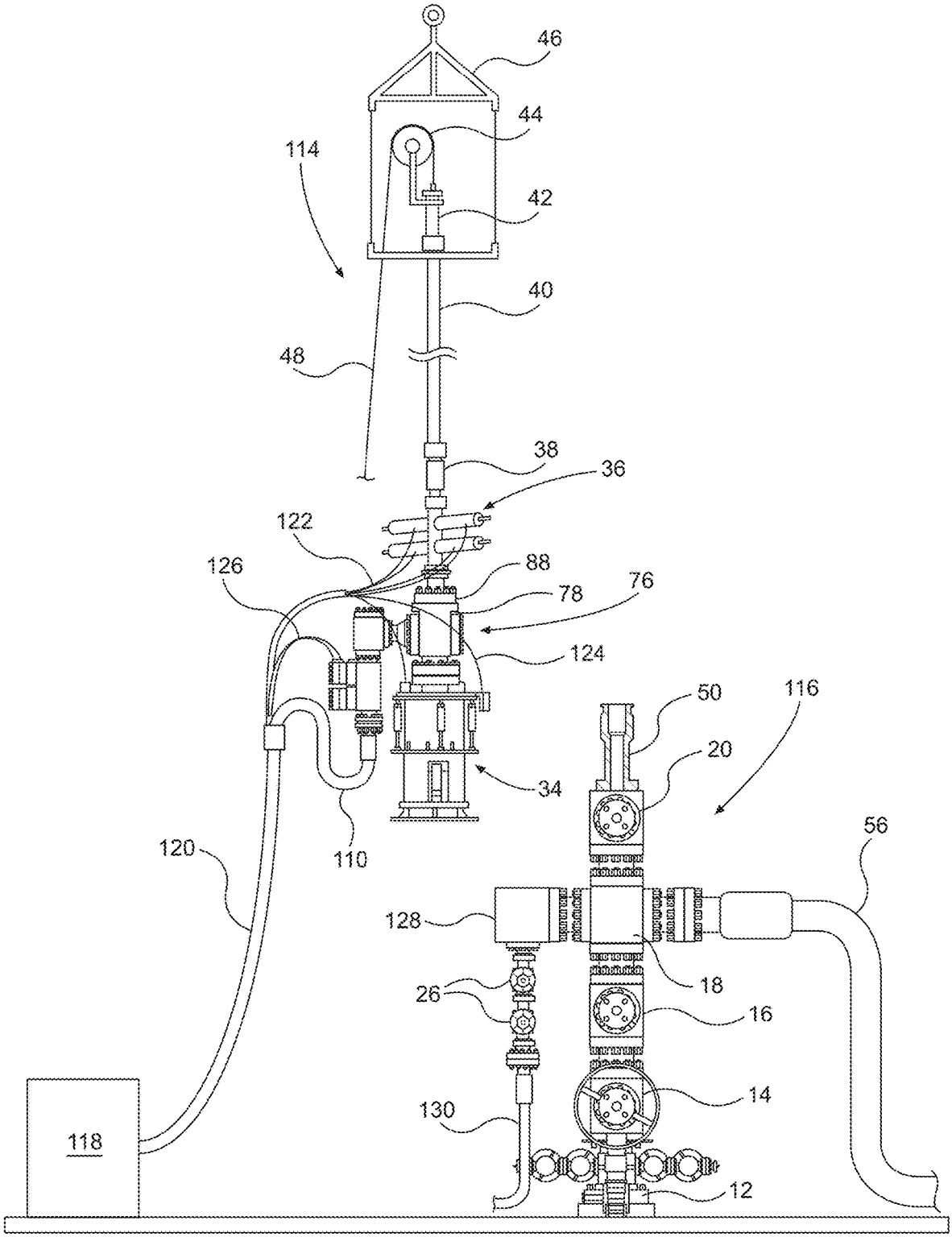
FIG. 5 is a front view of the pumpdown assembly of FIG. 4 shown incorporated into a wireline pressure control string which is positioned adjacent one embodiment of a wellhead assembly of the present disclosure in the form of a frac tree.

The present disclosure is also directed to a novel wireline pressure control string which includes the pumpdown assembly 76. One embodiment of such a wireline pressure control string (which may also be referred to as a wireline string or a wireline stack) is shown in FIG. 5. The wireline stack of this embodiment, which is indicated generally by reference number 114, comprises a pumpdown assembly 76 which is positioned between a first component above and a second component below. The first component may comprise any component which is normally present in a wireline stack configured for use in wireline operations, such as well fracking operations. For example, the first component may comprise one or more of a wireline BOP 36, a tool catcher 38, a lubricator 40, a stuffing box 42 or a grease injection control head.

In certain embodiments, the second component may comprise means by which the pressure control string 114 may be releasably secured to a frac tree or any other wellhead component positioned at the top of the well bore. In one embodiment, for example, the second component may comprise a power-operated connector, such as the connector 34 described above, which as shown in FIG. 5 is connectable to an adapter 50 mounted to the top of a frac tree 116. In an alternative embodiment, the second component may comprise an adapter (such as, e.g., the adapter 50) which is configured to be engaged by a power-operated connector (such as, e.g., the connector 34) mounted to the top of the frac tree 116 (or any other wellhead component positioned at the top of the well bore). In another embodiment, the second component may comprise a first connector half which is configured to be manually secured to a second connector half mounted to the top of the frac tree 116 (or any other wellhead component positioned at the top of the well bore).

The pumpdown assembly 76 may be connected to the first and second components by means of the top and bottom end connections 88, 90 described above. For example, the top end connection 88 may comprise a studded end connection which is configured to connect with a flanged end connection on the BOP 36. Likewise, the bottom end connection 90 may comprise a flanged end connection which is configured to be bolted to a flanged end connection on the connector 34. In an alternative, one or both of the end connections 88, 90 may comprise a threaded connection, such as a thread adapter. It should be noted, however, that the pumpdown assembly 76 need not be directly connected to the first and second components. Rather, the pumpdown assembly 76 may be connected to the first and second components through any number of fittings, connectors and components.

In the illustrative embodiment of the disclosure shown in FIG. 5, the wireline stack 114 is configured for performing wireline operations. In this embodiment, the wireline stack 114 comprises a connector (such as, e.g., the connector 34) for securing the wireline stack to the frac tree 116, a pumpdown assembly 76 connected to the top of the connector, a wireline valve or wireline BOP 36 connected to the top of the pumpdown assembly, a lubricator 40 positioned above the BOP 36, and means positioned above the lubricator 40 for sealing around the wireline 48, such as a stuffing box 42 or a grease injection control head. The wireline stack 114 shown in FIG. 5 may also include certain other components which are normally present in a wireline stack configured for use in wireline operations. For example, the wireline stack 114 may include a tool catcher 38 between the BOP 36 and the lubricator 40, a top sheave 44 for guiding the wireline 48 into the stuffing box 42 or grease injection control head, and a lifting tool 46 to enable the wireline stack 114 to be deployed using a crane or other lifting device.

In accordance with one embodiment of the present disclosure, the pumpdown assembly 76 is connected to the pumpdown fluid source 62 using a fluid conduit 110 in the form of a flexible flowline, such as, e.g., the SAFlex™ flexible flowline sold by TechnipFMC PLC of Houston, Texas. As shown in FIG. 4, the flexible flowline 110 includes a flanged end connection 112 which is configured to be bolted to the flanged end connection 108 of the valve assembly 80 of the pumpdown assembly 76. It should be noted, however, that the flexible flowline 110 may employ any other type of end connection which is configured to connect with a corresponding end connection on the valve assembly 80.

Figure 6:
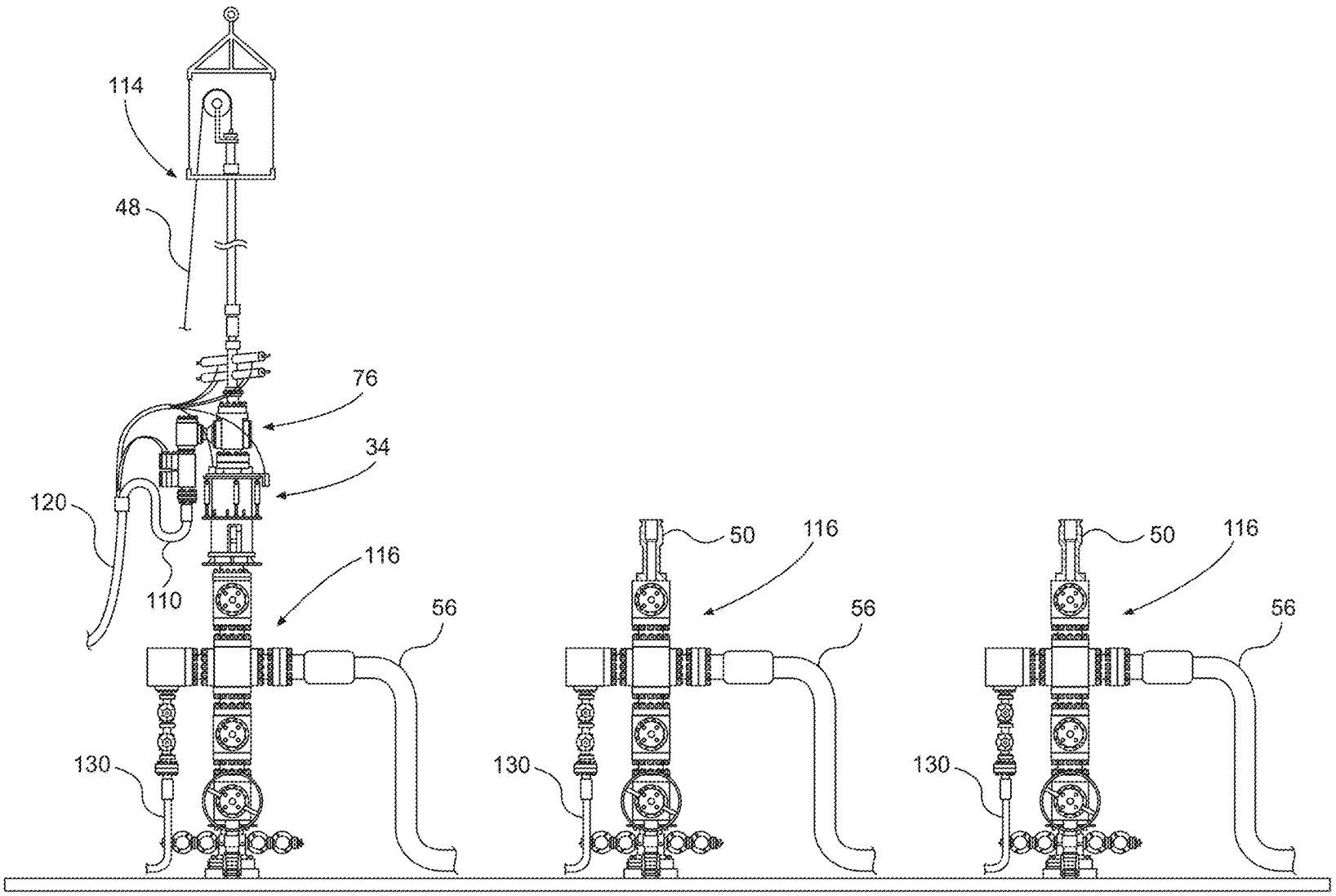
FIG. 6 is a front view of a frac pad which includes three frac trees of the type shown in FIG. 5 and depicting the wireline pressure control string of FIG. 5 connected to one of the frac trees.

The flexible flowline 110 provides several advantages. For example, the flexible flowline 110 can be connected to the pumpdown assembly 76 at or near ground level before the wireline stack 114 is lifted and connected to the top of the frac tree 116. In addition, as shown in FIG. 6, the flexible flowline 110 enables the wireline stack 114 to be conveniently moved from one frac tree to the next. Due to its inherent flexibility, the flowline 110 will not hinder movement of the wireline stack 114 from at or near ground level to the top of the frac tree 116 or from one frac tree to another frac tree. In contrast to this arrangement, if a rigid flowline assembly, such as the pumpdown flowline assembly 52 described above, were to be used to connect the pumpdown assembly 76 to the pumpdown fluid source, the rigid flowline assembly could only be connected to the pumpdown assembly after the wireline stack 114 is connected to the frac tree 116. What is more, in order to move the wireline stack 114 from one frac tree 116 to another frac tree, the rigid flowline assembly would have to be disconnected from the pumpdown assembly 76 and then reconnected to the pumpdown assembly once the wireline stack is connected to the second frac tree. These operations would not only be time consuming, but they would also require the use of a personnel stand or personnel lift to enable the frac crewperson to reach the pumpdown valve assembly.

Furthermore, when the wireline stack 114 includes a remotely operated connector, such as the Speedloc™-XT hydraulic connector described above, the flexible flowline 110 enables the wireline stack to be connected to a frac tree and moved from frac tree to frac tree without the need for any frac crewpersons to be present in the red zone, which is the area around the pressurized frac flowlines during a fracking operation. Thus, the connection of the wireline stack 114 to a frac tree 116 and the movement of the wireline stack from one frac tree to the next can be performed without having to wait until the completion of a fracking operation on another well.

Referring still to FIG. 5, in accordance with another embodiment of the present disclosure, the wireline stack 114 is connected to a conventional wireline control module 118 using a single umbilical 120 containing the flexible flowline 110 and some or all of the power and signal lines for the components of the wireline stack 114. Depending on the particular components of the wireline stack 114, the power and signal lines may include, for instance the power lines (e.g., hydraulic lines) 122 for the valves on the BOP 36, the power lines (e.g., hydraulic lines) and signal lines 124 for the connector 34 (which may include, e.g., data lines for sensors associated with the connector), and the power lines (e.g., hydraulic lines) 126 for the actuators 104 of the pumpdown assembly 76. Compared to the prior art wireline stack 32 shown in FIG. 2, in which the hydraulic lines 122 for the BOP valves and the hydraulic and signal lines 124 for the connector 34 are run independently, the umbilical 120 eliminates the risk that one or more individual lines will become snagged and/or damaged by equipment on the frac pad. Thus, the umbilical 120 makes moving the wireline stack 114 safer and more convenient.

In accordance with another embodiment of the disclosure, a frac tree 116 is provided which eliminates the need for pumpdown valves 28 on each frac tree and multiple pumpdown flowline assemblies 52 for connecting the pumpdown valves of each frac tree to the pumpdown fluid source 62. As shown in FIG. 5, the frac tree 116 may include a lower master valve 14, an upper master valve 16, a flow cross 18 and a swab valve 20. In this embodiment, the frac flowline 56 is connected to the flow cross 18, and one or more (e.g., two) flowback valves 26 are connected to a Tee fitting 128 which in turn is connected to the flow cross 18. However, the frac tree 116 does not include any pumpdown valves. Instead, the functionality of the pumpdown valves is provided by the wireline stack 114, and in particular the pumpdown assembly 76, described above. As a result, a pumpdown flowline assembly 52 is not required to connect the frac tree 116 to the pumpdown fluid source 62. This greatly simplifies not only the frac tree 116, but also the frac pad in general. In addition, this arrangement eliminates the possibility of a pumpdown operation being performed on the wrong frac tree, thus increasing safety on location as well as improving performance.

Figure 7:
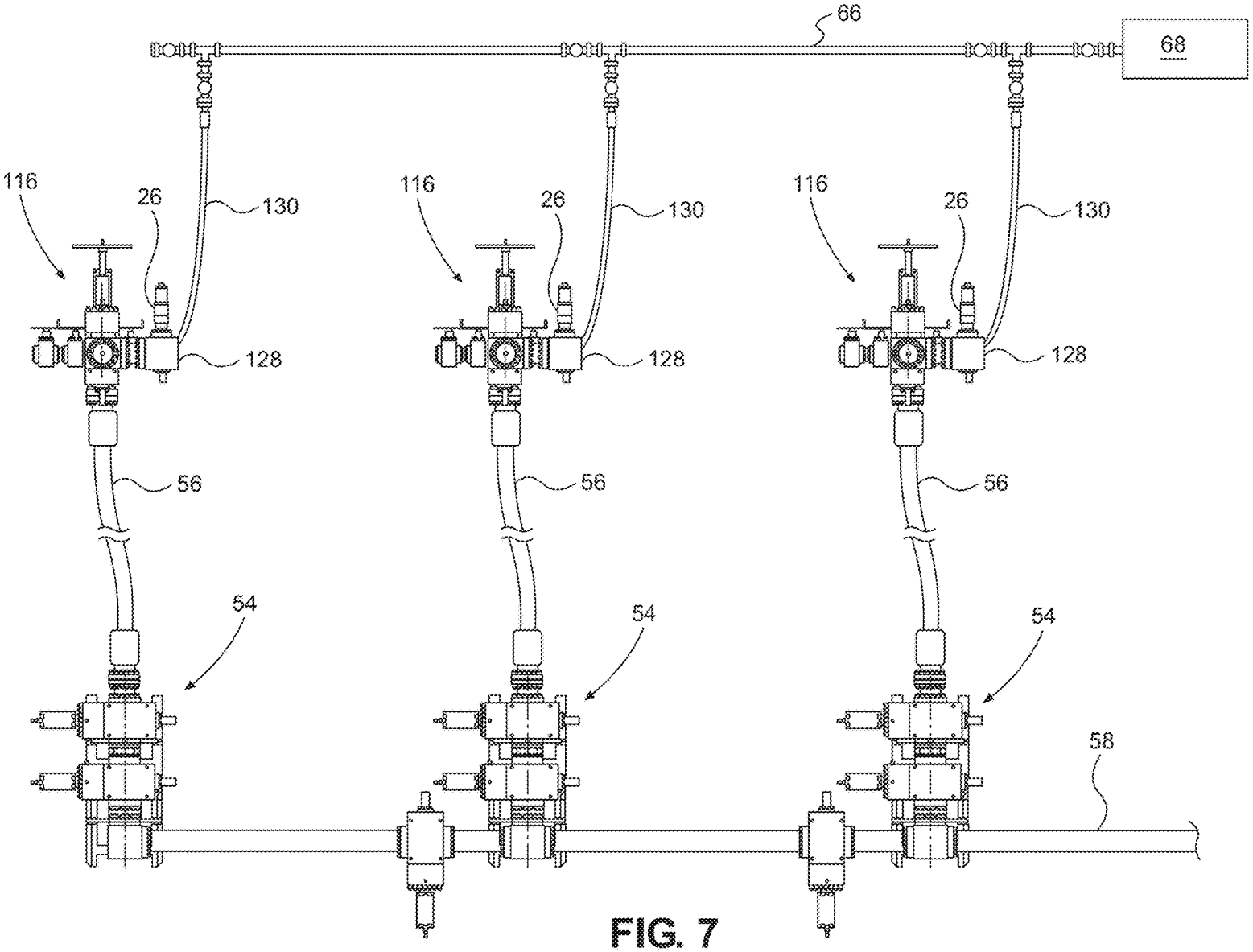
FIG. 7 is a top view of the pad depicted in FIG. 6.

Referring still to FIG. 5, in accordance with yet another embodiment of the disclosure, the flowback valves 26 of one or more of the frac trees 116 may be connected to the flowback apparatus 68 (e.g., a collecting tank or separation apparatus) using a flexible flowline 130, such as, e.g., the SAFlex™ flexible flowline described above. As shown in FIG. 7, the flowback valves 26 of each frac tree 116 are connected via a respective flexible flowline 130 to the common flowback flowline assembly 66, which in turn leads to the flowback apparatus 68. This arrangement greatly simplifies the frac pad by eliminating the multiple straight pipe segments, Tee fittings and plug valves which make up the individual flowback flowline assemblies 64 of the prior art frac pad shown in FIG. 3. As a result, the complete flowback flowline assembly (comprising the flexible flowline 130 and the common flowback flowline assembly 66) is less complicated and time consuming to assemble, and the numerous potential leak paths presented by the connections between the individual components of the complete flowback flowline assembly are eliminated.

It should be recognized that, while the present disclosure has been presented with reference to certain illustrative embodiments, those skilled in the art may develop a wide variation of structural and operational details without departing from the principles of the disclosure. For example, the various elements shown in the illustrative embodiments described above may be combined in a manner not specifically illustrated. Therefore, the following claims are to be construed to cover all equivalents falling within the true scope and spirit of the disclosure.

What is claimed is:

1. A pumpdown system for use in performing wireline operations on a well bore, the pumpdown system comprising:

a wellhead assembly positioned at the top of the well bore;

a pumpdown fluid source;

a flowline having a first end connected to the pumpdown fluid source and an opposite second end; and a wireline pressure control string releasably connectable to the wellhead assembly, the wireline pressure control string comprising:

a pumpdown sub having a body and a through bore which extends through the body;

at least one pumpdown valve having an inlet connected to the second end of the flowline and an outlet in fluid communication with the through bore; and a connector positioned below the pumpdown sub for releasably securing the wireline pressure control string to the wellhead assembly;

wherein in operation of the pumpdown system, the wireline pressure control string is connected to the wellhead assembly and fluid from the pumpdown fluid source is conveyed through the flowline, the pumpdown valve and the pumpdown sub into the well bore; and wherein during operation of the pumpdown system the wellhead assembly is not connected to the pumpdown fluid source other than through the flowline.

2. The pumpdown system of claim 1, wherein the flowline comprises a flexible flowline.

3. The pumpdown system of claim 1, wherein said at least one pumpdown valve comprises a power-operated valve actuator.

4. The pumpdown system of claim 1, wherein the wellhead assembly does not include a pumpdown valve connected to the pumpdown fluid source.

5. The pumpdown system of claim 1, further comprising a number of additional wellhead assemblies, each of which is positioned at the top of a corresponding one of a number of additional well bores, wherein during operation of the pumpdown system none of the wellhead assemblies has a valve physically connected to the pumpdown fluid source.

6. The pumpdown system of claim 1, further comprising a number of additional wellhead assemblies, each of which is positioned at the top of a corresponding one of a number of additional well bores; wherein none of the wellhead assemblies is connected to the pumpdown fluid source other than through the flowline.

7. A pumpdown system for use in performing wireline operations on a plurality of hydrocarbon wells, each well comprising a wellbore and a wellhead assembly positioned at the top of the wellbore, the pumpdown system comprising:

a pumpdown fluid source;

a flexible flowline comprising a first end connected to the pumpdown fluid source and an opposite second end;

a wireline pressure control string comprising:

a connector for releasably securing the wireline pressure control string in turn to each wellhead assembly;

a pumpdown sub positioned above the connector and having a body and a through bore which extends through the body; and at least one pumpdown valve having an inlet connected to the second end of the flexible flowline and an outlet in fluid communication with the through bore;

wherein during operation of the pumpdown system, the wireline pressure control string is connected in turn to each wellhead assembly and fluid from the pumpdown fluid source is conveyed through the fluid flowline, the pumpdown valve and the pumpdown sub into the well bore; and wherein during operation of the pumpdown system, none of the wellhead assemblies is physically connected to the pumpdown fluid source other than through the flexible flowline.

8. The pumpdown system of claim 7, wherein said at least one pumpdown valve comprises a power-operated valve actuator.

9. The pumpdown system of claim 8, wherein the connector comprises a power-operated connector.

10. The pumpdown system of claim 9, wherein the valve actuator is operated through at least one valve control cable, wherein the power-operated connector is operated through at least one connector control cable, and wherein said at least one valve control cable, said at least one connector control cable and said flexible flowline are combined in an umbilical.

11. A method for performing wireline operations on a plurality of hydrocarbon wells, each well comprising a well bore and a wellhead assembly positioned at the top of the well bore, the method comprising:

releasably connecting a wireline pressure control string to a first one of said wellhead assemblies;

pumping a fluid from a pumpdown fluid source through the wireline pressure control string and into the well bore corresponding to said first one of said wellhead assemblies;

disconnecting the wireline pressure control string from said first one of said wellhead assemblies;

releasably connecting the wireline pressure control string to a second one of said wellhead assemblies; and pumping a fluid from the pumpdown fluid source through the wireline pressure control string and into the well bore corresponding to said second one of said wellhead assemblies;

wherein the step of pumping a fluid through the wireline pressure control string is performed using a pumpdown assembly in the wireline pressure control string, the pumpdown assembly comprising:

a pumpdown sub having a body and a through bore which extends axially through the body; and at least one pumpdown valve having an inlet which is fluidly connectable to the pumpdown fluid source and an outlet which is fluidly connected to the through bore.

12. The method of claim 11, wherein said at least one pumpdown valve is fluidly connected to the pumpdown fluid source with a flexible flowline.

13. The method of claim 11, wherein said at least one pumpdown valve comprises a power-operated valve actuator.

14. The method of claim 11, wherein the step of releasably connecting the wireline pressure control string to said wellhead assemblies is performed using a remotely controlled connector positioned in the wireline pressure control string below the pumpdown assembly.

* * * * *